United States Patent [19]

Dunphy et al.

[11] Patent Number: 4,854,620

[45] Date of Patent: Aug. 8, 1989

[54] DOOR SET MOUNTING

[75] Inventors: Gerald F. Dunphy, Glen Waverley; Lance E. Best, Vermont South, both of Australia

[73] Assignee: Ogden Industries Pty., Ltd., Australia

[21] Appl. No.: 899,623

[22] Filed: Aug. 22, 1986

[30] Foreign Application Priority Data

Aug. 22, 1985 [AU] Australia ..... PH 2085

[51] Int. Cl.[4] ..... E05B 9/06

[52] U.S. Cl. ..... 292/337; 70/449; 70/451

[58] Field of Search ..... 292/337, DIG. 53, DIG. 54, 292/DIG. 64; 70/448, 449, 451, DIG. 3; 403/391, 397

[56] References Cited

U.S. PATENT DOCUMENTS

| | | | |
|---|---|---|---|
| 1,829,815 | 11/1931 | Schlage | 292/337 |
| 1,845,197 | 2/1932 | Schlage | 292/337 |
| 2,004,510 | 6/1935 | Schlage | 70/451 |
| 2,547,256 | 4/1951 | Cerf | 292/337 |
| 2,726,891 | 12/1955 | Gresham et al. | 292/337 |
| 2,836,452 | 5/1958 | Kubik et al. | 292/336.3 |
| 2,921,461 | 1/1960 | Schlage | 292/337 |
| 3,116,080 | 12/1963 | Williams | 292/337 |
| 3,279,836 | 10/1966 | Swanson | 292/337 |
| 4,407,537 | 10/1983 | Ames | 292/337 |
| 4,617,775 | 10/1986 | Padrun | 403/397 X |

FOREIGN PATENT DOCUMENTS

| | | | |
|---|---|---|---|
| 167617 | 8/1921 | United Kingdom | 292/337 |
| 431689 | 7/1935 | United Kingdom | 70/448 |

*Primary Examiner*—Lloyd A. Gall

*Attorney, Agent, or Firm*—Berman, Aisenberg & Platt

[57] ABSTRACT

A door set mounting including a baffle assembly formed of two circular sheet metal members arranged in face-to-face relationship, and a cylindrical tubular shroud also formed of sheet metal which extends around those members so as to be substantially coaxial therewith. Each circular member has a transversely extending channel formed therein and those channels combine to form a receptacle for a door latch housing. An opening formed through the base of each channel allows passage of a drive spindle for the latch. The two circular members are held in face-to-face relationship by a pair of clips, each of which straddles those members, and the same clips also serve to hold the shroud in assembly with the circular members. Preferably, the shroud is formed of two parts each of which is held by a respective one of the clips.

26 Claims, 4 Drawing Sheets

DOOR SET MOUNTING

BACKGROUND OF THE INVENTION

This invention relates to the mounting of knob or lever assemblies on doors and similar members which are retained in a particular position by a latch, deadbolt, or the like. It will be hereinafter convenient to describe the invention with particular reference to doors and latches, although as indicated above the invention has wider application. Thus, the word "door" as hereinafter used throughout this specification is to be understood as embracing other forms of support members to which a knob or lever assembly of the foregoing kind may be mounted.

Door sets of the foregoing kind generally include a knob or lever which is rotatably mounted on a rose or other mounting plate or assembly adapted to be secured to a surface of the door. A drive spindle connects that knob or lever with another knob or lever at the opposite side of the door. The knob or lever at one side of the door at least may include key operated locking mechanism which must be released in order for the knob or lever to be operable to actuate an associated latch assembly. In many cases the latch assembly includes a tubular housing which is mounted within a bore formed in an edge of the door, and a latch bolt slidably mounted in that housing for movement between projecting and retracted positions at which it can and cannot respectively cooperate with a strike secured to the door frame. The aforementioned drive spindle passes through the latch housing and cooperates with mechanism carried by that housing so that the latch bolt retracts in response to rotation of one of the knobs or levers.

It is generally the case that the diameter of the bore required to receive the latch housing is substantially less than that required to mount the associated door sets—i.e., the knob or lever assemblies. For example, the bore within the door edge for receiving the latch housing may be in the order of five eighths of an inch diameter, whereas a two and one eighth inch diameter hole extending transversely through the door and intersecting with the aforementioned bore may be required to mount the door sets. Special tools have been developed for producing such bores and holes of the diameters mentioned and because of the convenience of using those standard tools tradesmen commonly use the two and one eighth inch diameter boring tool even in situations where a smaller diameter hole may be adequate.

The aforementioned practice presents problems in situations where the door is required to have a standard suitable for fire installation purposes. A door set mounted in such a large diameter hole will usually be unacceptable for such purposes because if one of the door sets melts under fire conditions the other will be unsupported and can therefore fall away leaving a relatively large opening through which fire and smoke can pass.

One method of meeting the foregoing problem has involved providing a relatively small diameter hole through the door to accept the drive spindle and then counterboring from each side of the door to provide a large diameter cavity to mount the door sets. That has the disadvantage of requiring several boring operations and it is found in practice that some tradesmen tend to ignore the safety requirements and bore through the door in a single pass using the large diameter boring tool.

Yet another problem arises in hollow doors having fire insulating material between their outer face panels. Such material is commonly of a loose nature and it tends to fall into the space created by the through hole and latch housing bore and from there it can enter the latch and door lock mechanism and thereby disturb the operation of that mechanism.

SUMMARY OF THE INVENTION

It is an object of the present invention to provide improved means for mounting a door set on a door or other member. It is a further object of the invention to provide such mounting means which is suited for use in fire installations.

Mounting means according to the invention allows use of the conventional large diameter through hole in the door and is characterised in that it can be located within such a hole to provide a baffle between two door sets mounted on that door. In a preferred form, the mounting means also provides a support for one of those door sets in the event that the other melts or is otherwise detached from the door. In yet another preferred form, the mounting means includes a shroud which provides a lining within the aforementioned hole and thereby guards against ingress of foreign material to the latch and/or lock mechanism.

According to the present invention, there is provided a mounting for a door set including, a substantially circular mounting member of plate-like construction adapted to fit within and substantially close a hole formed through a support member such as a door, at least one opening formed through said mounting member for passage of a drive spindle of a latch actuator, and a receptacle forming part of said mounting member which is arranged to receive part of a housing for a latch so that the said latch can be operated through the said drive spindle.

In a preferred form, retention means is provided on the mounting member so as to cooperate with fastening means for holding at least one door set to a surface of the support member. The cooperation is such that separation of the mounting member and the door set is resisted with the result that the mounting member provides some degree of support for a door set. Furthermore, a cylindrical tubular shroud may be provided around the mounting member so as to be substantially coaxial therewith, and an opening is formed through that shroud and aligned with the receptacle of the mounting member so as to allow passage of a latch housing.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

DETAILS

The concept of the invention can be incorporated in a variety of different constructions, but it will be convenient to hereinafter describe one particular construction which has been found to be satisfactory in use.

Figure 5:
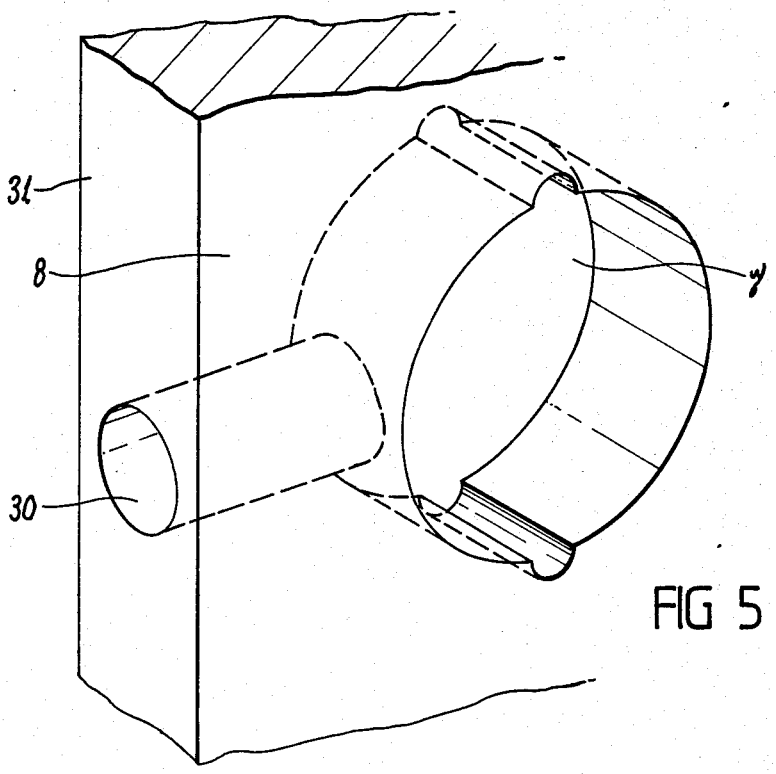
FIG. 5 is a semi-diagrammatic perspective view showing part of a door to which the assembly of FIG. 4 can be attached.
Figure 6:
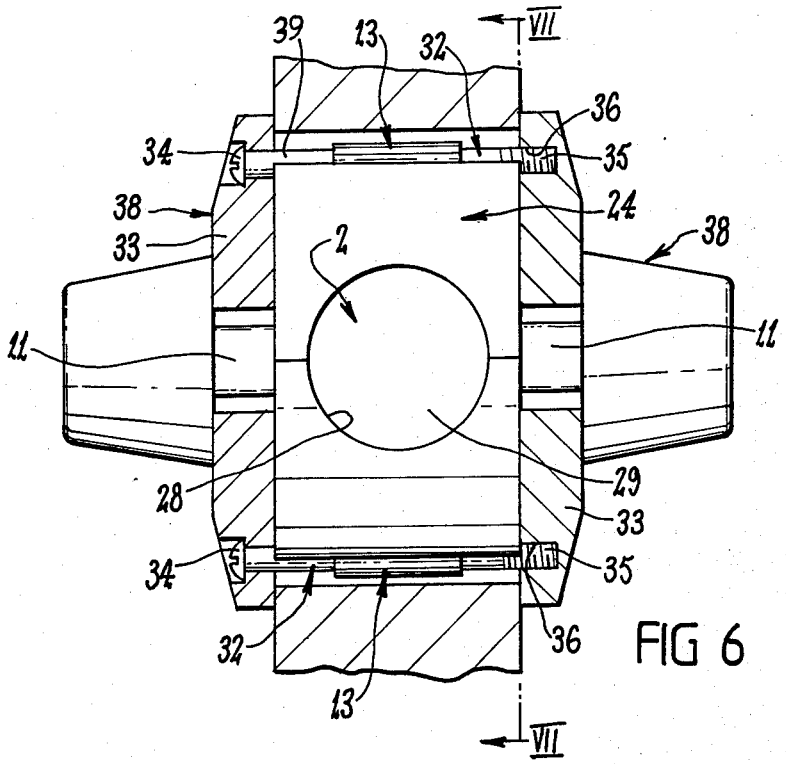
FIG. 6 is a partially sectioned view showing the assembly of FIG. 4 mounted in a door and two door sets connected to opposite surfaces of that door.
Figure 7:
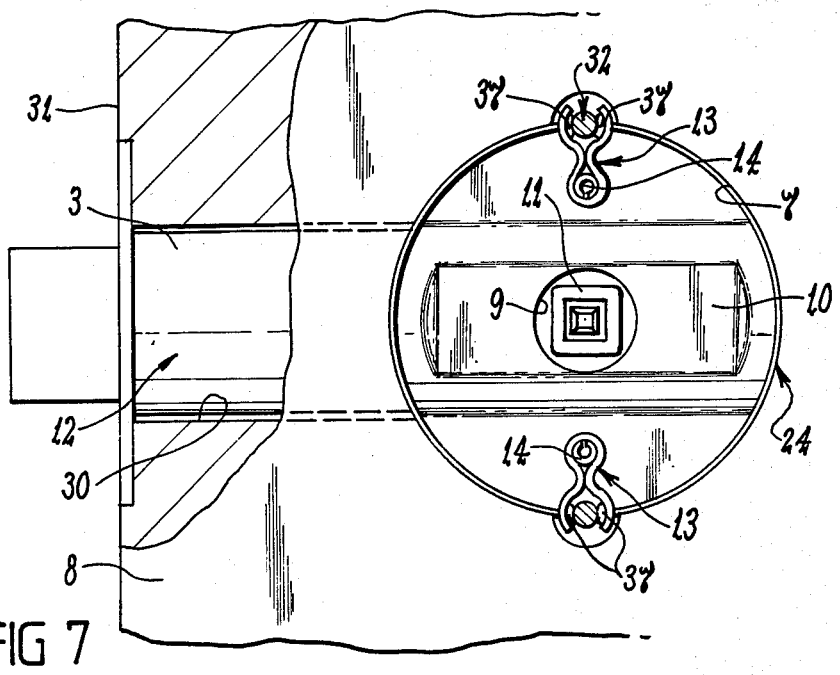
FIG. 7 is a cross-sectional view taken along line VII—VII of FIG. 6.

In the example construction shown, the mounting means includes a two-part baffle assembly 1 which also serves as a receptacle 2 for part of the latch housing 3 (FIG. 7). Each part 4 of the assembly 1 as shown comprises a plate-like member having a channel 5 extending diametrically thereacross. Such a channel 5 may be formed by appropriate bending or pressing of sheet material which also forms the section 6 of plate on each side of that channel 5. The peripheral shape of the plate-like member 4 may be generally circular as shown and is preferably of such a size as to fit relatively neatly within the cross hole 7 of a door 8 (FIGS. 5, 6 and 7).

Figure 2:
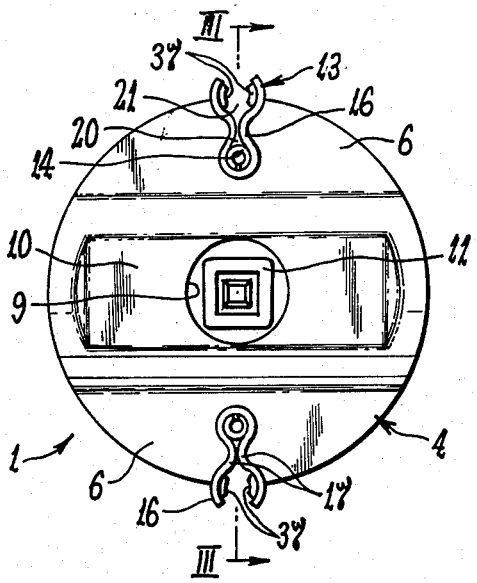
FIG. 2 is an end view of the mounting member of FIG. 1 shown in an assembled condition.
Figure 3:
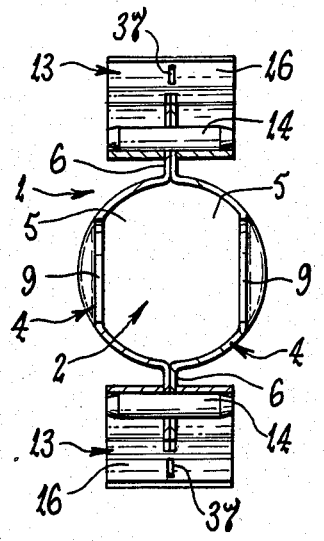
FIG. 3 is a cross-sectional view taken along line III—III of FIG. 2.

When the two plate-like members 4 are arranged in face-to-face relationship (FIG. 3), the opposed channels 5 cooperate or combine to form a tubular receptacle 2 for part of the latch housing 3. It is therefore preferred that each channel 5 has a cross-sectional shape generally complementary to that of one half of the part of the latch housing 3 which it is to receive. An opening 9 may be formed through the base 10 of each channel 5 to provide a passage for the latch drive spindle 11 (FIGS. 2 and 7), and the position of those openings 9 will be selected to coincide with the portion of the latch assembly 12 which is to receive that spindle 11.

In a variation (not shown) of the arrangement described, a channel 5 may be formed in one plate-like member 4 only and having a depth sufficient to receive substantially the full width of the latch housing 3. The other plate-like member 4 may then be substantially flat so as to provide a cover across the open mouth of that channel and if desired it need not extend substantially beyond the opposite sides of the channel. According to yet another variation a single channeled plate-like member may be used without the need for a second member of either flat or channeled form.

In the particular construction shown, securing means is provided to hold the two members 4 in face-to-face assembly. In the preferred arrangement shown, that securing means includes at least one clip 13 which straddles the two members 4 and is held against separation from the two members 4 by a suitable retainer 14. Preferably, as shown, there are two such clips 13 and they are located on respective opposite sides of the latch housing receptacle 2. Each clip 13 is adapted to engage over a portion of the baffle assembly 1 at which the first plate sections 6 of the two members 4 are in face-to-face engagement.

Figure 4:
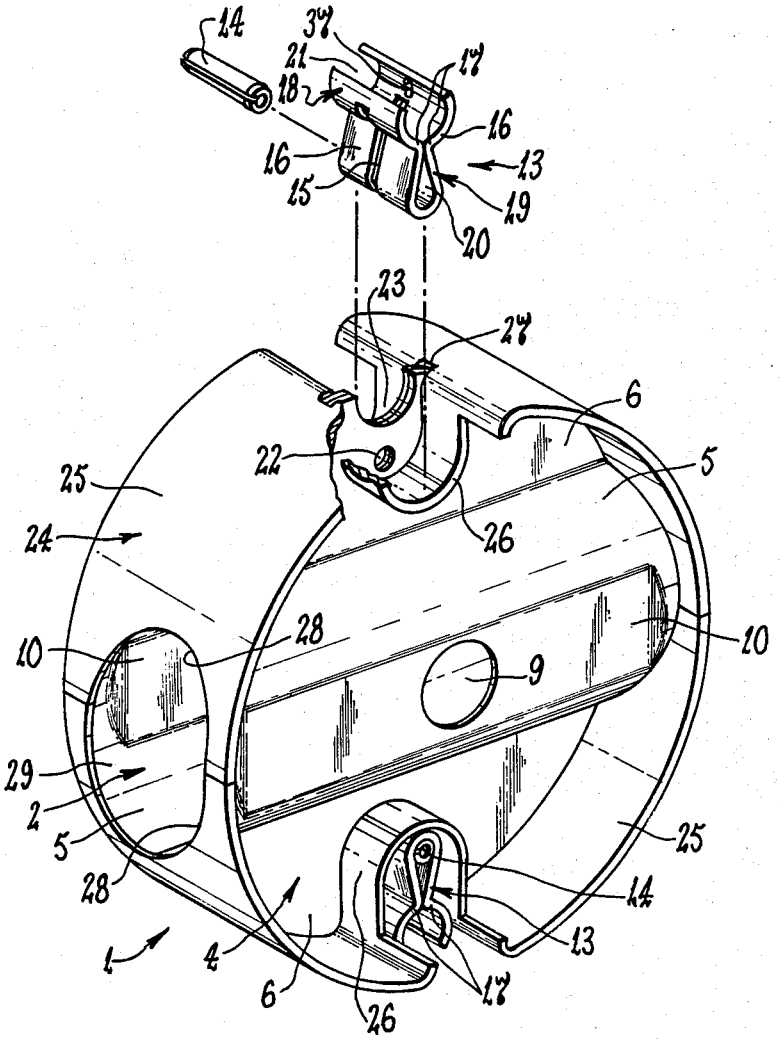
FIG. 4 is a perspective view of the mounting member of FIG. 2 with the two-part shroud of FIG. 1 attached.

In the particular form shown, each clip 13 (FIG. 4) is an elongate member having a slot 15 extending transversely therethrough and which is adapted to receive the two abutting plate sections 6. The slot 15 is dimensioned to neatly receive the two abutting plate sections 6 and it may be an interference fit over those sections 6. The clip 13 may be made from a section of sheet metal which is turned back upon itself to form two opposed wall parts 16 extending in the longitudinal direction of the clip 13. Preferably, as shown, each wall part 16 is contoured to form a longitudinally extending and inwardly directed ridge 17 which abuts against or lies close to the corresponding ridge 17 of the opposed wall part 16 and thereby divides the clip 13 into upper and lower parts 18 and 19 respectively (FIG. 4). The arrangement is such that the lower part 19 of the clip 13 has a longitudinally extending open-ended passage 20 formed therethrough and the upper part 18 also has such a passage 21 which, in the construction shown, is in the form of an open-topped channel. The transverse slot 15 extends through the lower part 19 of the clip 13 and possibly intrudes into the upper part 18 as shown.

It will be appreciated that a clip 13 having the general configuration described above can be formed other than by bending or pressing a section of sheet metal. Also, the passage 21 through the upper part 18 need not be an open-topped channel as described.

When the clip 13 is located over the plate sections 6 the lower part passage 20 aligns with a hole 22 formed through those plate sections 6 and thereby provides means for receiving a retainer 14 as referred to above. That retainer 14 may comprise a tubular member as shown in FIG. 4 which is split longitudinally so as to enable variation in its cross-sectional size. Preferably, that tubular retainer 14 is an interference fit within either the passage 20 or the associated hole 22, and in use projects through the hole 22 to locate within the passage 20 on both sides of the abutting plate sections 6. Obviously, other forms of retainers could be used.

It is preferred as shown that the periphery of the abutting plate sections 6 is provided with a recess 23 at the location at which the clip 13 is to be positioned so that in the mounted position of the clip 13 only a portion of the upper part 18 of the clip 13 projects beyond that periphery (FIG. 7). If desired, the clip 13 may be substantially fully contained within the recess 23 so there is no peripheral projection. It is further preferred that the recess 23 is such that there is no significant protrusion of the plate sections 6 into the passage 21 of the clip upper part 19. That passage 21 may provide an access way for door set fastening means as hereinafter described.

Figure 1:
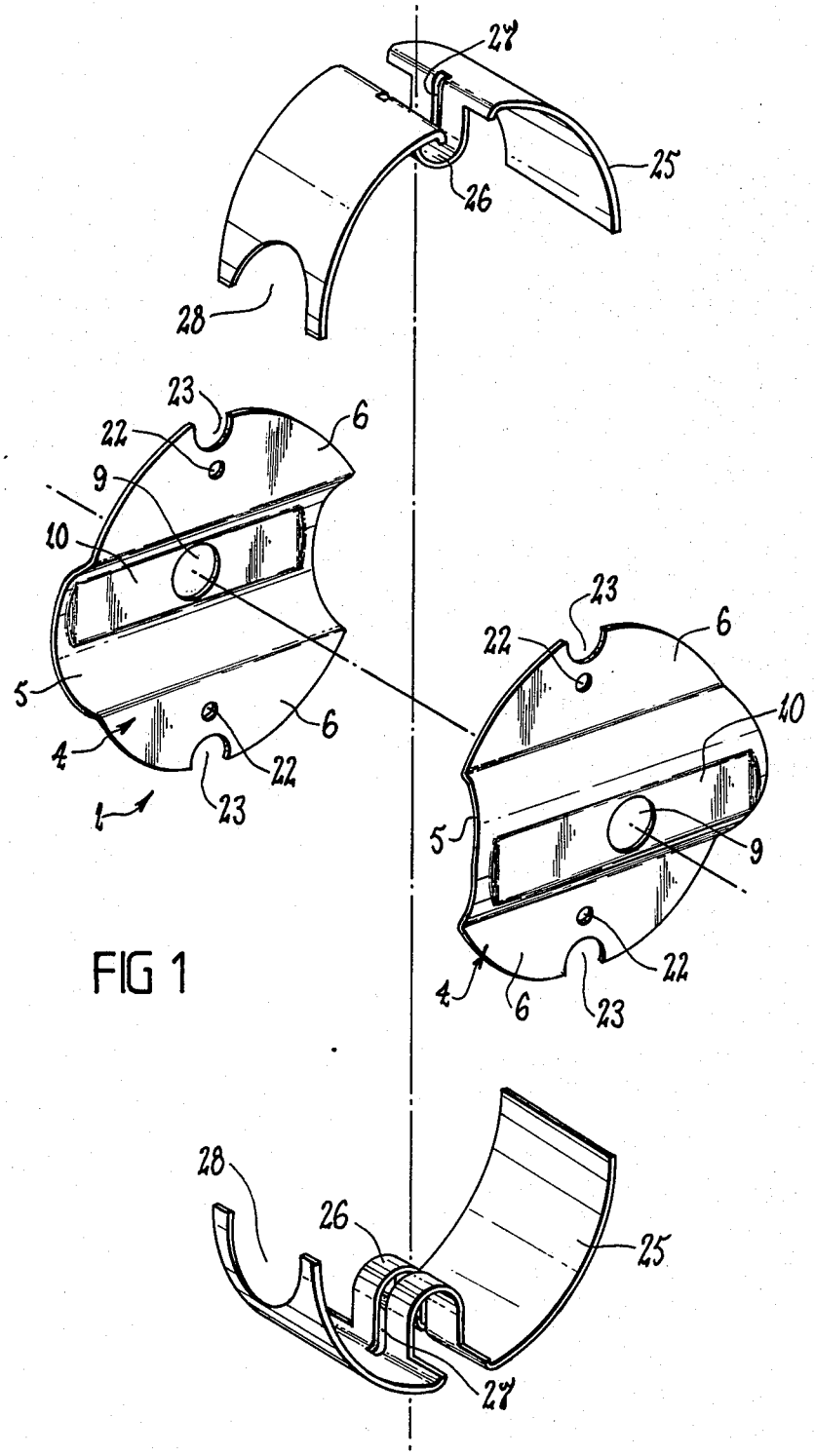
FIG. 1 is an exploded view of one form of mounting according to the invention which includes a two-part mounting member and a two-part cylindrical shroud.

According to one form of the mounting means, a substantially cylindrical shroud 24 (FIG. 4) is provided around the baffle assembly 1 and that form is particularly useful if the baffle assembly 1 is to be used with a door 8 having loose material in a cavity between its outer face panels. Such a shroud 24 may be composed of two part-cylindrical parts 25 as shown (FIG. 1), each of which can be conveniently formed from sheet metal. In the preferred arrangement shown, each shroud part 25 forms substantially one half of a cylinder and is dimensioned to fit neatly around the periphery of the baffle assembly 1. It is further preferred that the axial length of the shroud 24 is substantially equal to but no greater than the axial length of the through hole 7 in which it is to be located.

The two shroud parts 25 may be attached to the baffle assembly 1 in any appropriate manner. By way of example, as shown each such part 25 may have an inwardly directed and axially extending channel 26 formed at a location intermediate its ends and which is divided by a transversely extending slot 27. The slot 27 is positioned and dimensioned so as to receive the abutting plate sections 6 and the portions of the channel 26 separated by that slot 27 are arranged to pass beneath a respective projecting end portion of a respective one of the clips 13. It is preferred that the width of the channel 26 is not significantly greater than that of the clip 13.

It will be appreciated from the foregoing that the two shroud parts 25 can be located on the baffle assembly 1 prior to attachment of the clips 13. After those clips 13 are attached, the shroud parts 25 are retained against radial separation from the baffle assembly 1 and also against substantial rotation relative to that assembly 1. One pair of adjacent ends of the two shroud parts 25 may form a rear end wall for the tubular receptacle 2 and the other pair of adjacent ends may each be provided with a recess 28 which combine to form an opening 29. That opening 29 exposes an open front end of the receptacle 2.

A baffle assembly 1 as described can be conveniently located within the through hole 7 of a door 8 so that the plate sections 6 of that assembly 1 extend transverse to the axis of the hole 7. The baffle assembly 1 thereby effectively closes the hole 7, at a position between its ends, apart from the relatively small openings 9 which are provided for passage of the drive spindle 11. In that mounted condition the baffle assembly 1 is arranged so that the tubular receptacle 2 formed thereby is aligned with the latch housing bore 30 (FIG. 5) in the edge 31 of the door 8 and has the front end opening 29 outermost. Thus, when the latch assembly 12 is mounted on the door 8, the housing 3 thereof projects into the receptacle 2 and thereby secures the baffle assembly 1 against rotation about the axis of the through hole 7.

The two door sets 38 (FIG. 6) may be secured to their respective door surfaces by any suitable fastening means. It is generally preferred, however, to employ two fastening screws 32 which pass through the door 8 and cooperate with the mounting rose 33 of each door set 38. Each such screw 32 preferably has a head 34 at one end which abuts against an opposed surface of one mounting rose 33 and a screw-threaded end portion 35 which cooperatively engages with an internal thread 36 of the other mounting rose 33. Preferably, the two fastening screws 32 are located at opposite ends of a diameter of the through hole 7.

In the preferred construction described each fastening screw 32 extends axially through the upper part passage 21 of a respective one of the securing clips 13. It is preferred that holding means is provided to resist axial withdrawal of each screw 32 from its respective passage 21 and such holding means may be provided within that passage 21. By way of example, a transversely extending rib 37 may be formed on at least one side of the passage 21 at a location between its ends so as to engage with the screw thread 35 or bear against a plain section of the screw shank 39. Preferably, there are two such ribs 37 located in substantially opposed relationship. If desired, a plurality of such ribs 37 may be provided on each side of the passage 21.

The above described arrangement is such that when a screw 32 is fully inserted through the passage 21 to clamp the associated door sets 38 to the door 8, the two ribs 37 either engage with a threaded or non-threaded portion of the screw 32. In the former case at least one of the ribs 37 protrudes into the thread 35 and thereby provides a positive restraint against axial withdrawal of the screw 32. In the latter case the frictional engagement between the screw 32 and ribs 37 is such that a substantial axial force must be applied to the screw 32 to cause its withdrawal from the passage 21.

It will be appreciated from the foregoing that several valuable advantages arise from use of mounting means as described. A basic advantage is the ability to use a standard boring tool to form the through hole in a door since when the mounting means is located in such a hole it provides a substantial barrier between the hot and cold sides of the door in the event of a fire. In addition, the mounting means improves the basic security of the associated door sets because any attempt to force rotation of one of those door sets to improperly operate the associated latch will be effectively resisted by the cooperation between the latch housing and the tubular receptacle formed by the mounting means. Still further in the event of fire, the firm retention of the fastening screws within the mounting means provides secure retention of the door set on the cold side of the door should the corresponding set on the hot side melt or fall away. The provision of a shroud provides a further advantage in those applications involving hollow doors with loose material inside.

In addition to the foregoing, the mounting means is of relatively simple construction and requires a minimum number of assembly steps even in the situation where a shroud is provided. In that regard, the means for securing the two parts of the baffle in assembly also serves to secure the shroud in position.

Although the particular embodiment described has been described as formed of sheet metal, it will be appreciated that the mounting means can be formed in other ways and of other materials.

Various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. A mounting for a door set including a mounting member formed of two substantially circular plate-like members arranged in face-to-face engagement and being adapted to fit within and substantially close a hole formed through a support member, such as a door, an opening formed through each said plate-like member for passage of a drive spindle of a latch actuator, a receptacle formed between said plate-like members and being arranged to receive part of a housing for a latch so that the said latch can be operated through said drive spindle, a substantially cylindrical tubular shroud which extends around said mounting member so as to be substantially coaxial therewith and is formed of two part-cylindrical parts, an opening formed through said shroud and aligned with said receptacle to allow passage of said latch housing, and securing means which retains said plate-like members in face-to-face engagement and includes two clips, each of which straddles said plate-like members to hold them in said engagement, and each said clip also coacts with a respective said shroud part to hold that shroud part in assembly with the mounting member.

2. A mounting according to claim 1, wherein each said clip is cooperable with a respective one of two fastening screws for holding a door set to a said support member, each said clip includes holding means which effects said cooperation and said cooperation is such as to resist separation of a said fastening screw from the respective said clip.

3. A mounting according to claim 1, wherein each said shroud part is composed of a curved metal strip, each said clip overlies a portion of a respective one of said strips, and said securing means includes retaining means for each said clip which is in the form of a metal pin extending through the respective said clip and a hole in said mounting member so as to hold the clip on said overlying position.

4. A mounting according to claim 1, wherein the axis of each said opening intersects with said receptacle.

5. A mounting according to claim 1, wherein said receptacle is formed at least in part by a channel extending at least partway across said mounting member.

6. A mounting according to claim 1, wherein said receptacle is formed by a channel extending at least partway across at least one of said plate-like members, and a surface of the other said plate-like member is arranged in opposed and spaced relationship to the open mouth of said channel.

7. A mounting according to claim 6, wherein a said channel is formed in each said plate-like member and said channels are arranged in opposed relationship so as to combine to form said receptacle, and said surface of said other plate-like member is formed by the base of the channel of that member.

8. A mounting according to claim 6, wherein each said opening extends through the base of said channel.

9. A mounting according to claim 1, wherein said securing means includes retaining means which coacts with each said clip and said plate-like members to retain said clip in an operative position on said plate-like members.

10. A mounting according to claim 9, wherein each said clip comprises an upper part and a lower part, an open ended passage extends through said lower part, and a slot is formed in said lower part and extends transverse to the longitudinal axis of said passage so as to receive therein abutting sections of said plate-like members.

11. A mounting according to claim 10, wherein a further open-ended passage extends through said upper part in substantially parallel relationship to the passage of said lower part, and said further passage is adapted to receive a fastening screw for holding at least one door set to a surface of said support member.

12. A mounting according to claim 10, wherein said retaining means includes two elongate members, two holes are formed through said abutting section so that each is aligned with said passage of a respective said clip when the clip is operative, and each said elongate member extends through said passage of a respective said clip and the respective said aligned hole to hold said clip in position.

13. A mounting according to claim 1, wherein each said clip is formed of sheet metal.

14. A mounting according to claim 1, wherein said mounting member is formed of sheet metal.

15. A mounting according to claim 1, wherein retention means provided on said mounting member is cooperable with fastening means for holding at least one door set to a surface of said support member, said cooperation being such that separation of said mounting member and said door set is resisted.

16. A mounting according to claim 15, wherein said retention means includes an open-ended passage for receiving the shank of a fastening screw which constitutes said fastening means, and holding means is provided in said passage for engagement with said shank such as to resist withdrawal of said screw from said passage.

17. A mounting according to claim 6, wherein said holding means includes at least one rib which projects into said passage and extends substantially transverse to the longitudinal direction of said passage.

18. A mounting according to claim 15, wherein said retention means is releasably attached to said mounting member by means of retainer means.

19. A mounting according to claim 18, wherein said retention means includes said clips, each said clip has two substantially parallel open-ended passages formed therethrough, two holes are formed through said mounting member section, said retainer means includes two pins each of which extends through one of said passages of a respective said clip and a respective one of said holes to attach the clip to the mounting member, and the other said passage of each said clip is arranged to receive the shank of a respective fastening screw which forms said fastening means, and holding means is provided within each said other passage for engagement with the respective said shank such as to resist withdrawal of the respective said screw from said passage.

20. A mounting for a door set including, a mounting member formed of two substantially circular plate-like members arranged in face-to-face engagement and being adapted to fit within and substantially close a hole formed through a support member, such as a door, an opening formed through each said plate-like member for passage of a drive spindle of a latch actuator, a receptacle formed between said plate-like members and being arranged to receive part of a housing for a latch so that the said latch can be operated through said drive spindle, securing means which retains said plate-like members in face-to-face engagement and includes two clips and retaining means for each said clip, each said clip straddles said plate-like members to hold them in said face-to-face engagement and has two substantially parallel open-ended passages formed therethrough, each said retaining means extends through one said passage of the respective said clip and a hole formed through said mounting member so as to hold the respective said clip in assembly with said mounting member, and holding means is provided within the other said passage of each said clip so as to be cooperable with the shank of a fastening screw for holding a door set to a said support member, said cooperation being such as to resist withdrawal of said screw from said other passage.

21. A mounting for a door set including a mounting member formed of two substantially circular plate-like members arranged in face-to-face engagement and being adapted to fit within and substantially close a hole formed through a support member, such as a door, an opening through each said plate-like member for passage of a drive spindle of a latch actuator, a receptacle formed between said plate-like members and being arranged to receive part of a housing for a latch so that the said latch can be operated through said drive spindle, and securing means which retains said plate-like members in face-to-face engagement and includes two clips and retaining means for each said clip, each said clip straddles said plate-like members to hold them in said face-to-face engagement and comprises an upper part and a lower part, an open-ended passage extends through said lower part for receiving said retainer means whereby the respective said clip is held in an operative position on said plate-like members, and a slot is formed in said lower part and extend transverse to the longitudinal axis of said passage so as to receive therein abutting sections of said plate-like members.

22. A mounting according to claim 21, wherein a substantially cylindrical tubular shroud extends around said mounting member so as to be substantially coaxial therewith, and an opening is formed through said shroud, and is aligned with said receptacle to allow passage of said latch housing.

23. A mounting according to claim 15, wherein said shroud is formed of sheet metal.

24. A mounting according to claim 21, wherein a substantially cylindrical tubular shroud extends around said mounting member so as to be substantially coaxial therewith, an opening is formed through said shroud and is aligned with said receptacle to allow passage of said latch housing, said shroud is formed of two part-cylindrical parts, said clips straddle said plate-like members at substantially diametrically opposed positions on said plate-like members, and each said clip coacts with a respective said shroud part to hold that shroud part in assembly with the plate-like members.

25. A mounting according to claim 24, wherein each said shroud part has an inwardly directed and axially extending channel formed therein, and each said clip engages the base of a respective shroud part channel to effect said coaction with that shroud part.

26. A mounting according to claim 25, wherein each said shroud part channel is divided transversely by a slot which receives abutting sections of said plate-like members.

* * * * *